United States Patent [19]

McFarland

[11] 4,228,836

[45] Oct. 21, 1980

[54] KEY CASE

[75] Inventor: Donald McFarland, Santa Barbara, Calif.

[73] Assignee: Amity Leather Products Company, West Bend, Wis.

[21] Appl. No.: 66,650

[22] Filed: Aug. 15, 1979

[51] Int. Cl.[3] ..... A45C 11/32

[52] U.S. Cl. ..... 150/40

[58] Field of Search ..... 150/40; 70/456 R, 456 B, 70/457

[56] References Cited

U.S. PATENT DOCUMENTS

| | | | |
|---|---|---|---|
| 1,621,831 | 3/1927 | Colvin | 150/40 X |
| 2,470,466 | 5/1949 | Broughton | 150/40 |

*Primary Examiner*—Donald F. Norton

*Attorney, Agent, or Firm*—Fitch, Even, Tabin, Flannery & Welsch

[57] ABSTRACT

A key case with a rigid open-top box member having slots extending along its edges through which are received a flexible flap member for folding over the open top of the box member.

3 Claims, 7 Drawing Figures

KEY CASE

The present invention relates to key cases and more particularly to key cases having a rigid structure.

Key cases are utilized, of course, to conveniently carry around a set of keys. One such type of key case is constructed practically entirely of a flexible material such as leather or vinyl. The material is folded to form two flaps with metal key retainers affixed to a center portion between the two flaps.

This type of key case is relatively easy to manufacture and is readily made expansible so as to accommodate a greater or lesser number of keys. However, it suffers from a disadvantage in that the keys in the key case tend to bunch together and overlap so as to make the case lumpy and uncomfortable to carry around. Furthermore, the leather or vinyl can quickly wear out due to the abrasion of the material by the keys.

Another type of key case is typically constructed entirely of a rigid material such as metal or rigid plastic to form a box with a hinged lid or two hinged halves that come together to form the case.

These cases do not suffer from the disadvantages of the keys becoming bunched together or the keys cutting into the material, but are often bulky and too large to carry comfortably in a pocket. Moreover, they are not readily made collapsible or expansible, so as to accommodate greater or lesser numbers of keys.

It is an object therefore of the present invention to provide a key case obviating, for practical purposes, the above-mentioned disadvantages, and particularly in a relatively inexpensive manner. These and other objects and advantages will become obvious from the accompanying description and drawing in which.

Broadly stated, the preferred embodiment of the present invention comprises a rigid open box member for providing shape and rigidity to the key case, and a plurality of key retaining members for retaining the keys operably fixed to the top end of the rectangular member. A flexible flap member is foldably received through parallel edges of the box member for folding over the open side of the box member to provide an enclosure for receiving the keys. Closure means are provided for releasably joining the ends of the flap member. As will become apparent from the following detailed description of the construction of the preferred embodiment, it will be seen that a key case is provided which maintains its shape and organizes the keys within the box member.

Figure 6:
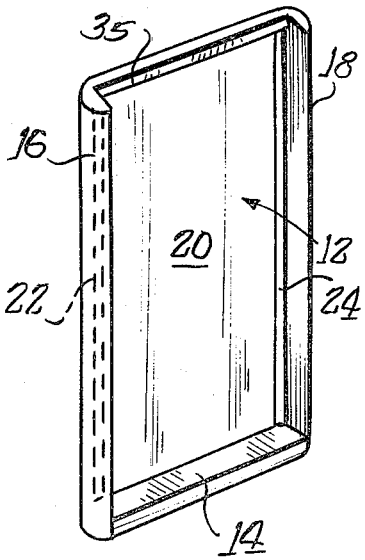
FIG. 6 is a perspective view of the rigid member of the key case of FIG. 1.

A key case 10 employing a preferred embodiment of the present invention is shown in FIGS. 1–5 and FIG. 7 to have a rigid rectangular three sided open box 12 (best seen in FIG. 6). The box 12 may be constructed of high-impact plastic or some other inexpensive rigid material. The box 12 is shown in FIG. 6 to have a flat rectangular bottom wall portion 14 and two side walls 16 and 18 together with an end wall 20 which define the three sided open box. Each of the side walls 16 and 18 defines a slot 22 and 24, respectively, along the edge between the side wall and the bottom wall 14 which runs the length of the box 12.

Through the slots 22 and 24 is inserted a flexible rectangular shaped material 26 which may be leather or some other flexible material. The material 26 is of a sufficient length to allow its end portions to be folded over the side walls 16 and 18 to meet in an overlapping relationship in front of the box 12 to form flaps 28 and 30, respectively.

The side walls 16 and 18 of the box 12 delineate a central portion 32 (FIG. 5) of the flexible material 26 which is between the side walls 16 and 18. Attached to the central portion 32 is the key retainer hardware 34 which has a plurality of key retainer hooks represented by hooks 36 and 38. The retainer 34 has a flattened portion 40 which is riveted to the central portion 32 of the flexible material 26 by a pair of rivets 42 and 44 (best seen in FIG. 5). The box 12 has a ridge 35 at the top end which helps secure the central portion 32 against shifting.

The side walls 16 and 18 of the rigid box 12 are of a sufficient height to allow room for the keys yet are small enough to insure that the key case has a slim profile for convenient carrying.

Figure 7:
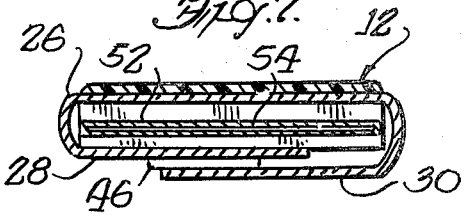
FIG. 7 is a top sectional view along the line 7—7 of FIG. 5.

The outer side of the side walls 16 and 18 are curved to facilitate folding of the flexible material 26 about the sides of the box to form the flaps 28 and 30 as shown in FIG. 7.

Figure 1:
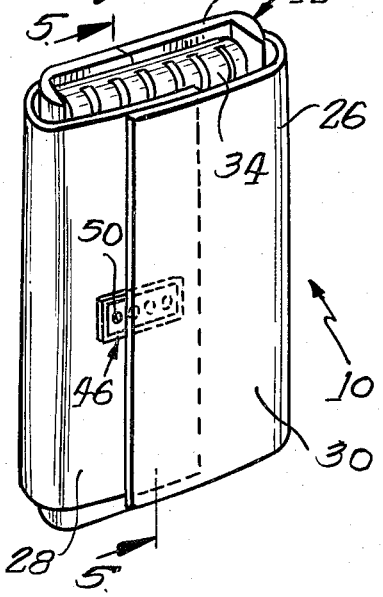
FIG. 1 is a perspective view of a key case embodying the present invention.
Figure 2:
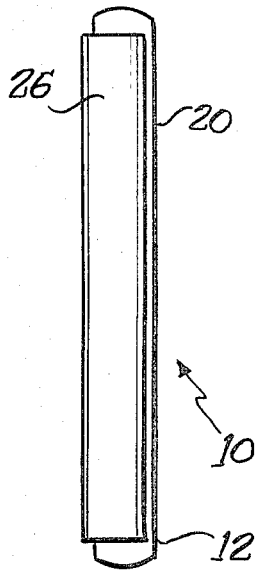
FIG. 2 is a side view of the key case of FIG. 1.
Figure 3:
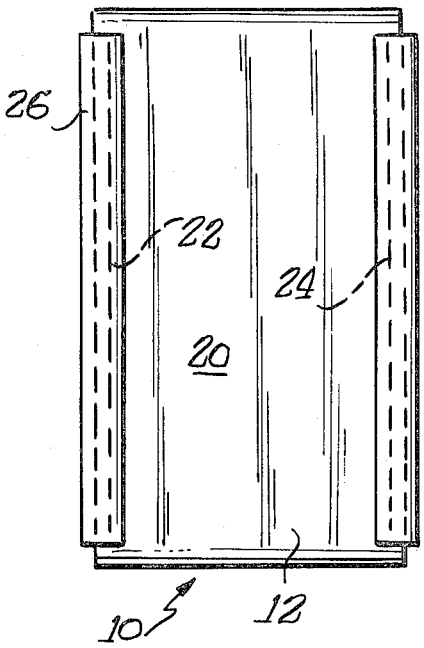
FIG. 3 is a back view of the key case of FIG. 1.
Figure 4:
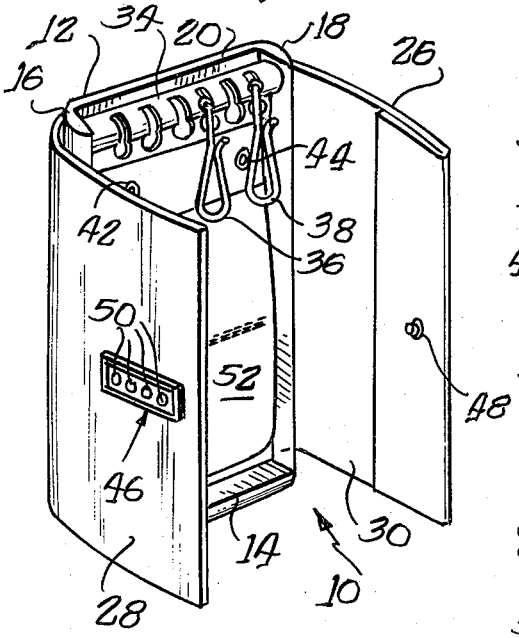
FIG. 4 is a perspective view of the key case of FIG. 1 with the flaps opened to show the interior of the key case.
Figure 5:
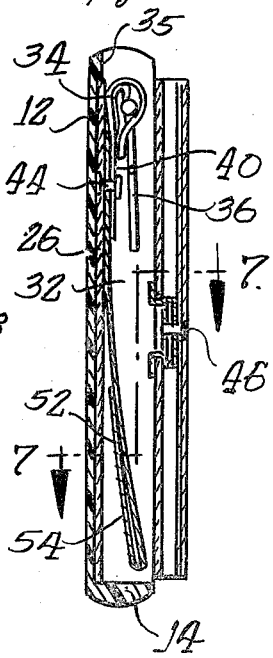
FIG. 5 is a sectional view taken along the line 5—5 of FIG. 1.

The flaps 28 and 30 form a flexible top wall to enclose the keys in the box 12. Since the flaps 28 and 30 are flexible instead of rigid, the front of the key case 10 can flex inward to further slim the profile of the key case and provide a comfortable side on which the key case may be placed into one's pocket. The two flaps 28 and 30 are fastened together with a snap fastener 46 to securely close the key case 10. The snap fastener 46 has a male portion 48 on flap 30 and a four hole female portion 50 on flap 28 as shown in FIG. 4. Thus, the snap fastener 46 may be adjusted so that the key holder can accommodate a greater or lesser number of keys.

Riveted between the key retainers 34 and the central portion 32 of the flexible material 26 is a flap 52 similarly constructed of flexible material, such as plastic or leather, which is folded back on itself and sealed at the side edges to form a pouch 54 (FIG. 5) which can be utilized to hold an additional key or to hold business cards or papers.

Thus, as can be seen from the above description, a key case is provided wherein the shape of the key case is maintained even though greater or lesser numbers of keys are carried. Furthermore, the rigid structure organizes the keys within the framework of the box 12 and keys stay in the key case more securely. The leather or flexible plastic parts will last longer since the keys are not as likely to abrade them and the high-impact plastic box 12 will hold up longer than an all leather key case.

It will, of course, be understood that modifications of the present invention, in its various aspects, will be apparent to those skilled in the art, some being apparent only after study, and others being really matters of routine mechanical design. As such, the scope of the invention should not be limited to any particular embodiment and specific construction herein described, but should be defined only by dependent claims, and equivalents thereof.

Various features of the invention are set forth in the following claims.

What is claimed is:

1. A key case comprising a rigid rectangular open-top box member for providing shape and rigidity to the key case; a plurality of key retaining members operably fixed to the interior of said rectangular box member; a flexible flap member received through slots extending along the edges of the rectangular member for folding over the open top of said rectangular box member; and means for releasably fastening the ends of said flap to each other.

2. The key case of claim 1 wherein one end of said flap member carries a male snap fastener element and the other end of said flap member carries a female snap fastener element positioned to engage the male element when the flap portions are folded over the open top of said rectangular box member.

3. The key case of claim 1 wherein the female snap fastener element has a plurality of openings so as to provide adjustable fastening positions.

* * * * *